313-422 SR
3/17/87 XR 4,651,049

United States Patent [19]
Saeki et al.

[11] Patent Number: 4,651,049
[45] Date of Patent: Mar. 17, 1987

[54] ELECTRODE ASSEMBLY FOR DISPLAY APPARATUS

[75] Inventors: Kiyoshi Saeki, Toyonaka; Sadao Watanabe, Ashiya, both of Japan

[73] Assignee: Matsushita Electric Industrial Co., Ltd., Osaka, Japan

[21] Appl. No.: 715,026

[22] PCT Filed: Jul. 20, 1984

[86] PCT No.: PCT/JP84/00370
§ 371 Date: Mar. 18, 1985
§ 102(e) Date: Mar. 18, 1985

[87] PCT Pub. No.: WO85/00692
PCT Pub. Date: Feb. 14, 1985

[30] Foreign Application Priority Data
Jul. 21, 1983 [JP] Japan ..... 58-133819

[51] Int. Cl.[4] ..... H01J 1/90; H01J 63/06
[52] U.S. Cl. ..... 313/355; 313/495; 313/422
[58] Field of Search ..... 313/495, 422, 355

[56] References Cited
U.S. PATENT DOCUMENTS
4,223,244 9/1980 Kishino et al. ..... 313/268 X
4,356,427 10/1982 Noguchi et al. ..... 313/422

*Primary Examiner*—Palmer C. DeMeo
*Attorney, Agent, or Firm*—Stevens, Davis, Miller & Mosher

[57] ABSTRACT

An electrode assembly for display apparatus is disclosed. A plurality of electrodes of different rigidities are provided between a cathode and a fluorescent material through coupling spacers. Plural kinds of coupling spacers are prepared in each of which the materials of a substrate metal, an insulating layer and a glass frit are different from each other and the proportional thicknesses of these components are varied to the extent that the intervals between the electrodes of different rigidities are not changed are prepared. An electrode block is completed by arranging the electrodes and the spacers such as to cancel the rotating moment around the neutral axis of the electrode block and joining them by means of calcination. The assembling accuracy of the electrode block is heightened very advantageously for positional accuracy with respect to the fluorescent screen.

4 Claims, 13 Drawing Figures

| | RATE OF THERMAL EXPANSION ($1/°C \times 10^{-7}$) | RIGIDITY (kg/mm) | PLATE THICK-NESS (mm) |
|---|---|---|---|
| ELECTRODE | 110.7 | 838.0 | 0.2 |
| SPACER | 109.5 | 748.7 | 0.4 |
| ELECTRODE | 110.7 | 12.3 | 0.1 |
| SPACER | 109.5 | 748.7 | 0.4 |
| ELECTRODE | 110.7 | 838.0 | 0.2 |
| SPACER | 109.5 | 748.7 | 0.4 |
| SPACER | 109.5 | 748.7 | 0.4 |
| ELECTRODE | 110.7 | 838.0 | 0.2 |
| SPACER | 105.4 | 420.4 | 0.4 |
| ELECTRODE | 110.7 | 12.3 | 0.1 |
| SPACER | 105.4 | 420.4 | 0.4 |
| ELECTRODE | 110.7 | 767.7 | 0.2 |

| | RATE OF THERMAL EXPANSION ($1/°C \times 10^{-7}$) | RIGIDITY (kg/mm) | PLATE THICKNESS (mm) |
|---|---|---|---|
| ELECTRODE | 110.7 | 838.0 | 0.2 |
| SPACER | 115.9 | 508.8 | 0.4 |
| ELECTRODE | 110.7 | 12.3 | 0.1 |
| SPACER | 105.4 | 420.4 | 0.4 |
| ELECTRODE | 110.7 | 838.0 | 0.2 |
| SPACER | 109.5 | 748.7 | 0.4 |
| SPACER | 109.5 | 748.7 | 0.4 |
| ELECTRODE | 110.7 | 838.0 | 0.2 |
| SPACER | 105.4 | 420.4 | 0.4 |
| ELECTRODE | 110.7 | 12.3 | 0.1 |
| SPACER | 115.9 | 508.8 | 0.4 |
| ELECTRODE | 110.7 | 767.7 | 0.2 |

ELECTRODE ASSEMBLY FOR DISPLAY APPARATUS

BACKGROUND OF THE INVENTION

This invention relates to an electrode assembly for a display apparatus, and more particularly to an electrode assembly capable of increasing accuracy in assembly and eliminating deficiencies in images.

The structure of a display apparatus on which our experiments have been carried out will first be explained. FIGS. 1 to 6 schematically show the display apparatus.

In FIG. 1, reference numeral 1 represents a fluorescent screen, 2 a cathode, 3 coupling spacers and 4 electrodes. An electron beam which has been emitted from the cathode 2 is subjected to horizontal and vertical deflection and luminance modulation by means of the various electrodes 4 and reaches the fluorescent screen 1 to cause light emission.

On the electrodes 4 are provided electron beam passage holes 8, 8' and 8'', as shown in FIGS. 2, 3 and 4, such that the electron beam passes therethrough. The rigidity of the electrodes 4 varies depending on the configuration and the size of the electron beam passage holes 8, 8' and 8''. For example, comparing the electrodes 5, 6 and 7 shown in FIGS. 2, 3 and 4, the ridigity in relation to tension and compression in the horizontal direction, as viewed in the Figures, is highest in the electrode 6, the rigidity of the electrode 5 being slightly lower than that of the electrode 6. This is because horizontal cleats 10' are continuous and vertical cleats 11' (clearance between two holes 8', 8') are wide in the electrode 6, which produces a stress flow in the cleats 11' with respect to tension and compression (in the horizontal direction), whereby the rigidity of the horizontal cleats 10' and the vertical cleats 11' are combined. In the electrode 5, however, although the horizontal cleats 10 are continuous, vertical cleats 11 are not so wide as that of the electrode 6 and are not wide enough to produce a stress flow, so that the rigidity is approximately equal to that of the horizontal cleats 10 which are naturally low in comparison with the electrode 6. Since in the electrode 7, there are no continuous horizontal cleats, the rigidity is extremely low as compared with the electrodes 5 and 6.

The coupling spacer 3 is essentially composed of a metal substrate 12 with an insulator 13 being attached thereto for the purpose of controlling the thickness and with a frit glass 14 for coupling being applied on the insulator 13.

The electrodes 4 are not joined and fixed until after all of the electrodes which constitute an electrode block have been completed. A unit is made by joining several electrodes 4 and by joining and fixing all the units constituting the block to complete, the final electrode block. This is because this method of joining the units can bring about higher accuracy in the block than the method of joining and fixing all the electrodes 4 at one time.

A method of making a unit of a part from electrodes 4 will next be explained. An example of joining and fixing electrodes 6 of the highest rigidity and electrodes 7 of the lowest ridigity through the coupling spacer 3 is illustrated in FIG. 6. At this time, each of the electrodes 6 and 7 must be positioned correctly in relation to each other, and it is also required that the dimensions a and b in FIG. 6 are equal and correspond with the printing pattern pitch (not shown) of the fluorescent screen 1.

The electron beam passes through a window portion W at right angles to the plane of the drawings, and since the electron beam is more sensitive to the positional accuracy of the electrodes in the horizontal direction (direction X), and, in terms of the printing pattern of the fluorescent screen 1, the electrodes should be positioned with greater precision in the horizontal direction than in the vertical direction (direction Y).

Positioning of each of the electrodes 5, 6 and 7 relative to one another is conducted by inserting pins (not shown) into locating holes 9, 9' and 9'' which are formed with high accuracy in the electrodes 5, 6 and 7. The coupling spacers 3 function to insulate the electrodes 5, 6 and 7 from one another, and maintain spaces of, predetermined dimension therebetween.

It is possible to form an end block by joining and fixing the units formed in the above-described way by means of the coupling spacers 3 and the remaining electrode 4.

The above is a summary of the structure and the manufacturing method of the display apparatus.

The problems of accuracy in assembly which arise with the above-described structure and manufacturing method will now be described.

The frit glass 14 is calcined at a temperature of 400°–500° C. Since during heating, it is not hardened until the temperature is reached, thermal stress is not generated in the interior of each layer of the electrode block consisting of the electrodes 4 and the coupling spacers 3. At the time of cooling the frit glass has already been hardened and each electrode has been fixed by the coupling spacers 3, so that thermal stress is produced in the interior of each electrode 4 and each coupling spacer 3 (the metal substrate 12, the insulator 13 and the frit glass 14). As a result, the electrode block composed of joined and fixed electrodes warps in the direction Z, whereby the riding position of the electron beam on the fluorescent screen 1 deviates from its correct position and the screen presents a phenomenon of chromatic error. The reason why warp is produced on the electrode block is that, since the distribution of the thermal stress generated on each layer of the electrodes 4 and the coupling spacers 3 is out of balance in relation to the neutral axis of the electrode block, rotating moment is produced in relation to the neutral axis. The distribution and magnitude of the thermal stress produced on each layer of the electrodes 4 and the coupling spacers 3 is determined by the material constant thereof (rate of thermal expansion, rigidity, plate thickness or the like).

A conventional electrode block is composed of electrodes 6, 7, 6, 6, 7, 5, which are disposed in that order in the direction from the cathode 2, one coupling spacer 3 being disposed between adjadent electrodes 4 with the proviso that two coupling spacers 3 are inserted between the third electrode 6 and the fourth electrode 6 from the cathode 2. The structure of each electrode 4 of this electrode block is determined under the state wherein focusing of the electron beam on the fluorescent screen is optimum, and due to a large difference in ridigity between the electrode 6 closest to the cathode 2 and the electrode 7 closest to the fluorescent screen 1, this structure is far from symmetrical in relation to the neutral axis of the electrode block.

Though the positional accuracy is required to be ±10 μm (+ means that the electrode block warps such to be convex relative to the fluorescent screen 1, and − indicates the reverse) in the last stage of coupling units, by virtue of the above-described phenomena an accuracy of only about ±200 μm has often been obtained.

SUMMARY OF THE INVENTION

Accordingly it is an object of the invention to heighten the assembling accuracy of an electrode block and its positional accuracy on the fluorescent screen in the electrode assembly for a display apparatus.

With this aim, an electrode assembly for a display apparatus according to the invention is composed of a plurality of electrodes of different rigidities which are provided between a cathode and a fluorescent screen through coupling spacers. Plural kinds of coupling spacers are prepared each of which consists of at least three layers which are composed of different materials and arranged in thickness of varying proportions with respect to each other, though the total thickness and configuration may be the same. An electrode assembly for display apparatus is provided by joining and fixing electrodes of different rigidities with at least one of the coupling spacers disposed between adjacent electrodes by means of calcination in such a manner that the rotating moment around the neutral axis of the electrode block consisting of the plurality of electrodes and the plural kinds of spacers is cancelled.

The above and other objects, features and advantages of the present invention will become clear from the following description of the preferred embodiment thereof, taken in conjunction with the accompanying drawings.

BRIEF DESCRIPTION OF THE DRAWINGS

FIG. 5(*b*) is a plan view of the coupling spacer shown in FIG. 5(*a*);

FIG. 6(*b*) is a side elevational view in section of the combination shown in FIG. 6(*a*);

DESCRIPTION OF THE PREFERRED EMBODIMENT

Figure 7A:
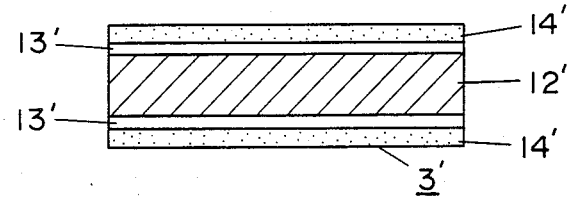
FIGS. 7(*a*), (*b*) and (*c*), respectively are sectional views of coupling spacers of different materials and thicknesses.
Figure 7B:
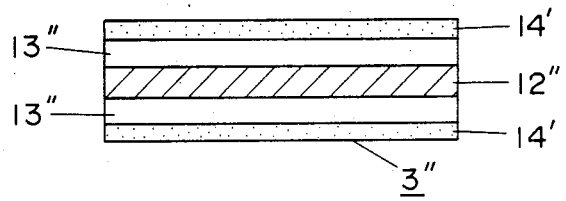
Figure 7C:
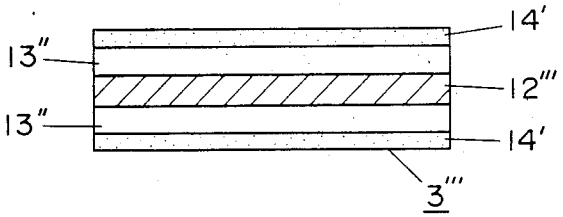

Hereinunder an embodiment of the present invention will be described in detail with reference to FIGS. 7 to 9. Supposing that, with respect to the n-th layer and the i-th layer, the forces applied onto the i-th layer and the j-th layer are $P_i$(Kg) and $P_j$(Kg), respectively, and a temperature change is ΔT(°C.), $$\alpha_i \cdot \Delta T + P_i/b_i t_i E_i = \alpha_j \cdot \Delta T + P_j/b_j t_j E_j \quad (1)$$

wherein

| wherein | |
|---|---|
| rate of thermal expansion (l/°C.) is | $\alpha_i$, $\alpha_j$ |
| Young's modulus (Kg/mm$^2$) | $E_i$, $E_j$ |
| plate thickness (mm) | $t_i$, $t_j$ |
| equivalent width (mm) | $b_i$, $b_j$. |

Rigidity is represented by the following formula:

$$K = P/\Delta L = Ebt/L \quad (2)$$

wherein L(mm) denotes a span in the direction X and L(MM) the amount of micro-deformation.

The following equation is obtained by substituting the formula (2) for the formula (1).

$$\alpha_i \cdot \Delta T + P_i/K_i L = \alpha_j \cdot \Delta T + P_j/K_j L \quad (3)$$

Then, by transposition, equation (4) is obtained.

$$-P_i/K_i + P_j/K_j = (\alpha_i - \alpha_j)\Delta T \cdot L \quad (4)$$

If the number of the entire layer constituting the electric block is n, the matrix is represented as follows:

$$\begin{bmatrix} -1/K_1 & 1/K_2 & o & o & \cdots & o & o \\ o & -1/K_2 & 1/K_3 & o & \cdots & o & o \\ \cdot & \cdot & \cdot & \cdot & & \cdot & \cdot \\ \cdot & \cdot & \cdot & \cdot & & \cdot & \cdot \\ \cdot & \cdot & \cdot & \cdot & & \cdot & \cdot \\ o & o & o & o & & -1/K_{n-1} & 1/K_n \\ 1 & 1 & 1 & 1 & \cdots & 1 & 1 \end{bmatrix} \cdot \begin{bmatrix} P_1 \\ P_2 \\ \cdot \\ \cdot \\ \cdot \\ P_{n-1} \\ P_n \end{bmatrix} = \begin{bmatrix} \alpha_1 - \alpha_2 \\ \alpha_2 - \alpha_3 \\ \cdot \\ \cdot \\ \cdot \\ \alpha_{n-1} - \alpha_n \\ o \end{bmatrix} \cdot \Delta T \cdot L \quad (5)$$

If the matrix including the rigidity K is expressed as (K), the column vector including the inner pressure P as {P} in the left member, and the column vector in the right member is expressed as {A}, the equation (5) is rearranged as follows.

$$[K] \cdot \{P\} = \{A\} \quad (6)$$

Therefore, the inner pressure P acting on the electrode block is represented as follows:

$$\{P\} = [K]^{-1} \cdot \{A\} \quad (7)$$

Figure 1:
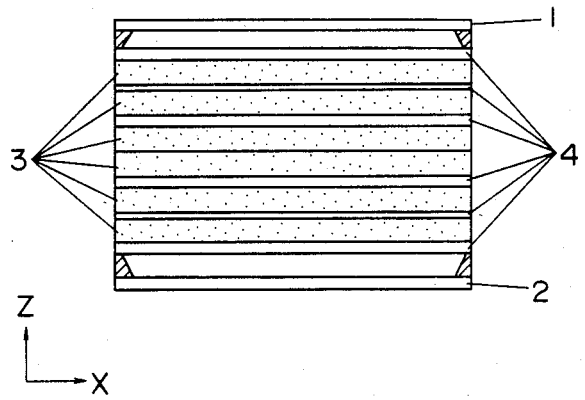
FIG. 1 is a sectional view of the structure of a display apparatus.
Figure 2:
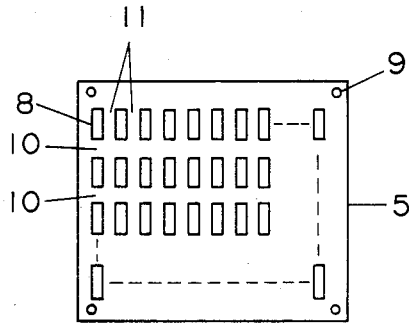
FIGS. 2 to 4 are plan views of electrodes for use in the display apparatus shown in FIG. 1.
Figure 3:
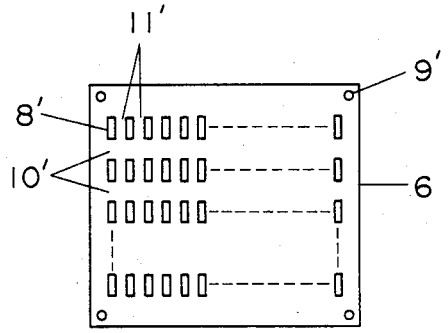
Figure 4:
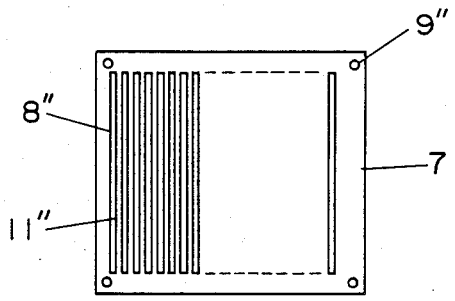
Figure 5A:
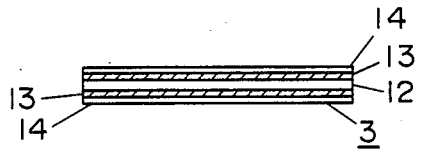
FIG. 5(*a*) is a sectional view of a coupling spacer for use in the apparatus.
Figure 5B:
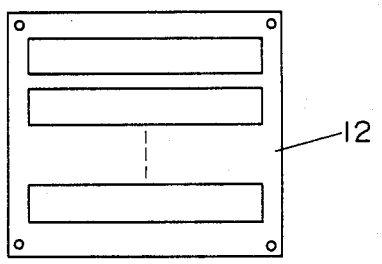
Figure 6A:
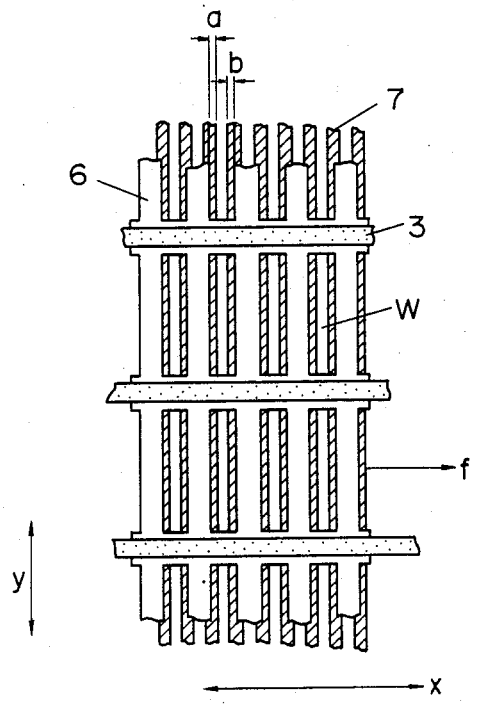
FIG. 6(*a*) is a plan view in section of the combination of electrodes and spacers in the apparatus.
Figure 6B:
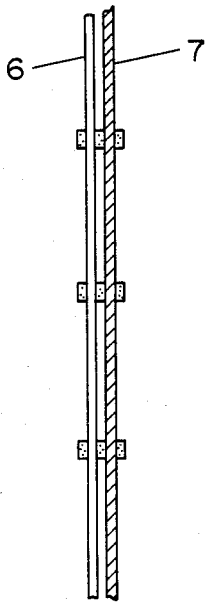

By using the equation (7), the inner pressure which is produced on each layer of the conventional electrode block by means of thermal hysteresis is obtained. Here, it is supposed that the electrode block is composed of the electrode 6, the spacer 3', the electrode 7, the spacer 3', the electrode 6, the spacer 3', the spacer 3', the electrode 6, the spacer 3'', the electrode 7, the spacer 3'' and the electrode 5, which are disposed in that order in the direction from the cathode 2. The fundamental structures and functions of the spacers 3' and 3'' are, as shown in FIGS. 7(*a*) and 7(*b*), the same as those of the coupling spacer shown in FIG. 5, but the plate thicknesses of the components are slightly different from them. In the spacer 3', the metal substrate 12 is 426 alloy of 0.2 mm in thickness, the insulating layer 13 is 9741 (glass code number) of 0.035 mm thickness on one side, and the glass frit 14 is 7575 (glass code number) of 0.065 mm in thickness on one side. In the spacer 3'', the material of each component is the same as that of the spacer 3', but the thickness of the metal substrate 12 is 0.1 mm, that of the insulating layer 13 is 0.085 mm and that of the glass frit 14 is 0.065 mm.

Figure 8:
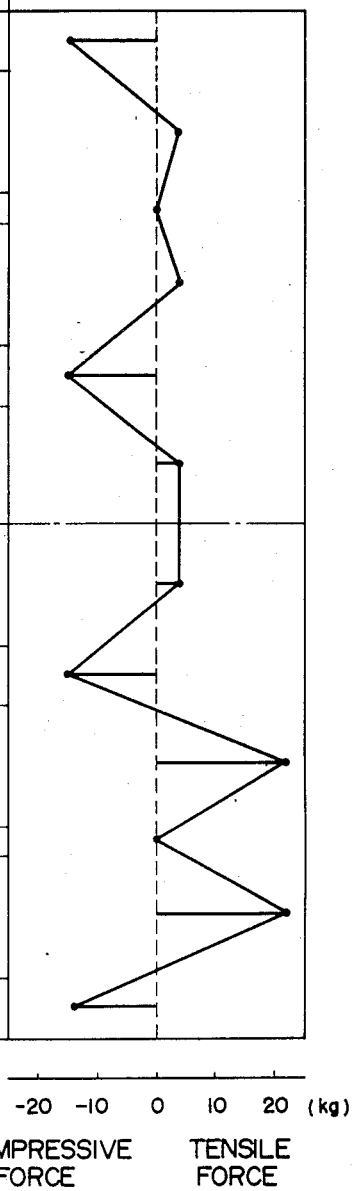
FIG. 8 is an explanatory view of the distribution and magnitude of the force applied to every layer and the material constant in the conventional electrode block.

The result of calculation of the inner pressure produced on each layer of the electrode block of the above-described constitution by using the equation (7) is shown in FIG. 8. This Figure shows that there is poor symmetry with respect to the neutral axis of the electrode block, and that a large rotating moment with respect to the neutral axis is generated.

An embodiment of the invention will next be explained, in which a part of the spacers 3 is replaced by spacers 3''' in which the materials and the thicknesses of the components are changed. The spacer 3''' having components of different materials and thickness are usable because the function of the spacer 3 is only to insulate respective electrodes 4 from one another and to space them apart by a predetermined dimension and so far as that function is satisfied, the material and the thickness of each component is not restricted.

The electrode block according to the preferred embodiment of the invention is composed of the electrode 6, the spacer 3''', the electrode 7, the spacer 3'', the electrode 6, the spacer 3', the spacer 3', the electrode 6, the spacer 3'', the electrode 7, the spacer 3''' and the electrode 5, which are disposed in that order in the direction from the cathode 2. The spacer 3''' has the structure shown in FIG. 7(*c*), the metal substrate 12 is US 430 of 0.2 mm thickness, the insulating layer 13 is 9741 (glass code number) of 0.8 mm on one side and the glass frit 14 is 7575 (glass code metal) of 0.065 mm thickness.

Figure 9:
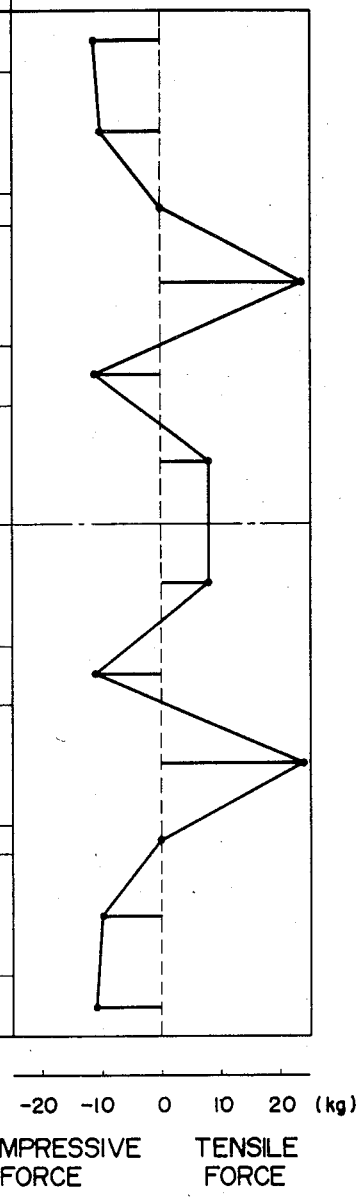
FIG. 9 is an explanatory view of the distribution and magnitude of the force applied to every layer and the material constant in the electrode block according to the invention.

The result of calculation of the inner pressure which is produced on each layer of the electrode block by using the equation (7) is shown in FIG. 9. As is obvious from the drawing, the distribution and the magnitude of the inner pressure is approximately symmetrical with respect to the neutral axis of the electrode block, and little rotating moment with respect to the neutral axis is generated, whereby the warp of the electrode block is made extremely small.

As described above, an electrode assembly according to the invention is characterized in that a part of the coupling spacers 3 are replaced by the spacers 3''' in which the materials and thicknesses of the components are changed, whereby the distribution and magnitude of the inner pressure produced on each layer of the electrode block are varied, lack of symmetry in the rigidity of each electrode with respect to the neutral axis is moderated, the rotating moment with respect to the neutral axis is roughly cancelled and warp of the electrode block is made extremely small. Adoption of this structure is very effective in that the deficiencies in images in the prior art, such as chromatic error or unevenness, are eliminated and yield in the manufacturing process is heightened to enable a realized cost reduction.

As described above, according to the invention, by replacing a part of the coupling spacers by spacers having components of different materials and thicknesses therefrom, the distribution and magnitude of the inner pressure produced on each layer of the electrode block are varied, lack of symmetry in the rigidity of each electrode with respect to the neutral axis is moderated, the rotating moment with respect to the neutral axis is roughly cancelled and warp of the electrode block is made extremely small, whereby the assembling accuracy of an electrode block can be improved from ±200 μm, as in the prior art, to not greater than ±10 μm.

In addition, though the spacer in the preferred embodiment of the invention is composed of five symmetrically arranged layers of three different kinds of materials, it is possible to ensure symmetry with respect to the neutral axis by arranging at least two kinds of materials in symmetrical or asymmetrical arrangements of at least five layers. Furthermore, though six electrodes are used in the embodiment, electrodes of any desired number from 2 to 6 is usable with plural kinds of spacers each of which may have components of different materials and thicknesses from the others other without degenerating the assembling accuracy of the electrode block.

While there has been described what is at present considered to be a preferred embodiment of the invention, it will be understood that various modiffications may be made therein, and it is intended that the appended claims cover all such modifications as fall within the true spirit and scope of the invention.

What is claimed is:

1. An electrode assembly for a hot cathode display apparatus, comprising:

a plurality of planar metallic electrodes containing apertures therein, the apertures of at least one of said electrodes being of different shape than the apertures of at least another one of said electrodes, said metallic electrodes being arranged in parallel with the apertures of all of said electrodes aligning in a predetermined direction;

a plurality of spacers, at least one of said spacers being disposed between and being bonded with each adjacent pair of said parallelly arranged electrodes, all of said electrodes and spacers being bonded together to form an electrode unit, said spacers having slits therein and being arranged such that said slits align with the apertures of said electrodes in said predetermined direction, each of said spacers comprising a substrate metal material coated on its opposite surfaces with at least one layer of an insulating material, said spacers including at least two different kinds of spacers, at least one of the substrate metal and coating of insulating material being varied in at least one of material and ratios of thickness in the two different kinds of spacers, so that moments in the electrode unit due to thermal stresses with respect to a neutral axis in a thicknesswise direction of said electrode unit are substantially cancelled.

2. An electrode assembly as in claim 1 wherein said plurality of electrodes includes metallic electrodes of different rigidities.

3. An electrode assembly as in claim 1 wherein the coatings of said spacers are formed by mineral materials.

4. An electrode assembly as in claim 1 wherein said electrodes and spacers are bonded together by being calcinated.

* * * * *